US007620490B2

(12) United States Patent
Matsunaga

(10) Patent No.: US 7,620,490 B2
(45) Date of Patent: Nov. 17, 2009

(54) FUEL INJECTION CONTROL DEVICE FOR INTERNAL COMBUSTION ENGINE

(75) Inventor: Akio Matsunaga, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/885,998

(22) PCT Filed: Mar. 8, 2006

(86) PCT No.: PCT/JP2006/305066

§ 371 (c)(1),
(2), (4) Date: Feb. 8, 2008

(87) PCT Pub. No.: WO2006/095908

PCT Pub. Date: Sep. 14, 2006

(65) Prior Publication Data

US 2008/0275627 A1 Nov. 6, 2008

(30) Foreign Application Priority Data

Mar. 9, 2005 (JP) ..... 2005-065551

(51) Int. Cl.
*F02D 41/30* (2006.01)
*F02D 21/08* (2006.01)

(52) U.S. Cl. ..... 701/108; 123/568.11; 60/605.2

(58) Field of Classification Search ..... 701/101–104, 701/108, 109; 123/568.11, 568.16, 568.21, 123/434–436; 60/605.2
See application file for complete search history.

(56) References Cited

U.S. PATENT DOCUMENTS 5,921,223 A * 7/1999 Fukuma ..... 123/568.21
6,000,385 A * 12/1999 Fukuma ..... 123/704
6,041,602 A * 3/2000 Dickey ..... 60/605.2
6,055,810 A * 5/2000 Borland et al. ..... 60/600
6,142,119 A * 11/2000 Abe et al. ..... 123/435
6,725,829 B2 * 4/2004 Kataoka et al. ..... 123/299
6,857,263 B2 * 2/2005 Gray et al. ..... 60/278

(Continued)

FOREIGN PATENT DOCUMENTS

EP 1 460 251 A2 9/2004

(Continued)

*Primary Examiner*—Stephen K Cronin
*Assistant Examiner*—Johnny H Hoang
(74) *Attorney, Agent, or Firm*—Kenyon & Kenyon LLP

(57) ABSTRACT

The invention provides a fuel injection control device for an internal combustion engine that can improve the accuracy of combustion control regarding smoke suppression. The fuel injection control device is applied to an engine provided with an EGR device for returning, as a part of an intake gas flown into the cylinder, an EGR gas, withdrawn from an exhaust passage, to an air intake passage. The amount of oxygen OXM contained in the intake gas and the concentration of oxygen OXC contained in the intake gas are detected (steps S1 and S2). The smoke tolerable limit value QOXMLMT as the upper limit of the amount of fuel injection, which can suppress the amount of smoke generated in the engine to a predetermined tolerance range, is set based on the detected amount of oxygen and concentration of oxygen (step S4), and, when the required amount of injection QDMD determined based on operation conditions is larger than the tolerable limit value QOXMLMT, the instructional injection amount QFIN is limited to the tolerable limit value QOXMLMT.

3 Claims, 11 Drawing Sheets

U.S. PATENT DOCUMENTS

| | | | | |
|---|---|---|---|---|
| 7,031,824 | B2 * | 4/2006 | Gangopadhyay | 701/108 |
| 7,069,907 | B2 * | 7/2006 | Sasaki et al. | 123/432 |
| 7,155,332 | B2 * | 12/2006 | Yamada et al. | 701/108 |
| 7,188,606 | B2 * | 3/2007 | Ishikawa | 123/399 |
| 7,383,118 | B2 * | 6/2008 | Imai et al. | 701/104 |

FOREIGN PATENT DOCUMENTS

| | | | |
|---|---|---|---|
| JP | 9-004519 | | 1/1997 |
| JP | 9-126060 | | 5/1997 |
| JP | 9-195825 | A | 7/1997 |
| JP | 10-037786 | | 2/1998 |
| JP | 2002-327638 | A | 11/2002 |
| JP | 2002-364437 | A | 12/2002 |
| JP | 2004-278431 | A | 10/2004 |
| JP | 2005-23826 | A | 1/2005 |

* cited by examiner

FUEL INJECTION CONTROL DEVICE FOR INTERNAL COMBUSTION ENGINE

This is a 371 national phase application of PCT/JP2006/305066 filed 8 Mar. 2006, claiming priority to Japanese Patent Application No. 2005-065551 filed 9 Mar. 2005, the contents of which are incorporated herein by reference.

TECHNICAL FIELD

The invention relates to a fuel injection control device for an internal combustion engine having a function of limiting the amount of fuel injection so as to suppress the generation of smoke.

BACKGROUND ART

As a fuel injection control device for a diesel engine with an EGR device, a fuel injection control device is proposed, for example, in the patent publication JP-A-9-195825, in which the concentration of oxygen in an intake gas flown into the cylinder is detected with a sensor, the amount of oxygen therein is computed from the result of the detection, and then the maximum amount of fuel injection necessary to suppress the amount of generated smoke to the tolerable limit is determined based on the computed amount of oxygen. Other prior art documents regarding the present invention include JP-A-9-126060, JP-A-9-4519, and JP-A-10-37786.

The amount of generated smoke correlates with the combustion speed in the cylinder. The combustion speed varies according not only to the amount of oxygen in the intake gas but also to the composition of the intake gas. That is, even if the same amount of oxygen is contained in the intake gas, the combustion speed slows down and smoke is generated more easily, for example, when the partial pressure of a molecule such as CO2 and H2O having large specific heat increases as the EGR ratio increases. The conventional fuel injection control device detects the concentration of oxygen and uses the detected concentration of oxygen only for computing the amount of oxygen. However, the conventional fuel injection control device does not take the variation of the concentration of oxygen into consideration when the smoke tolerable limit value is determined. Accordingly, the control of combustion speed regarding smoke suppression may not be performed accurately enough.

SUMMARY OF THE INVENTION

Thus, an object of the invention is to provide a fuel injection control device for an internal combustion engine that can improve the accuracy of combustion control regarding smoke suppression.

The present invention solves the above problem with a fuel injection control device applied to an internal combustion engine having an EGR device for returning, as a part of an intake gas flown into the cylinder, an EGR gas, withdrawn from an exhaust passage, to an intake passage. The fuel injection control device includes an oxygen amount detection device for detecting the amount of oxygen contained in the intake gas; a concentration detection device for detecting the concentration of a specific gas contained in the intake gas or a value representing the concentration; and a smoke tolerable limit value setting device for setting the smoke tolerable limit value as the upper limit of the amount of fuel injection, which can suppress the amount of smoke generated in the engine to a predetermined tolerance range, based on the results detected by the oxygen amount detection device and the concentration detection device.

According to the fuel injection control device of the present invention, since the smoke tolerable limit value regarding the amount of fuel injection is determined based not only on the amount of oxygen but also on the concentration of a specific gas contained in the intake gas or a value representing the concentration, the effect of the variation of the composition of the intake gas on the generation of smoke can be reflected in the smoke tolerable limit value, thereby to improve the accuracy of the control of combustion speed regarding smoke suppression.

In an aspect of the present invention, the concentration detection device may detect the concentration of oxygen as the concentration of the specific gas; and the smoke tolerable limit value setting device may set the smoke tolerable limit value on the basis of the detected amount of oxygen and the concentration of oxygen. In this aspect, the effect of the composition of the intake gas on the combustion can be recognized using the concentration of oxygen, so that the detected concentration of oxygen can be reflected in the setting of the smoke tolerable limit value.

In the aspect of detecting the concentration of oxygen, the fuel injection control device may further include an EGR valve opening degree detection device for detecting the fully closed condition of an EGR valve provided to the EGR device. When the EGR valve opening degree detection device detects the fully closed condition, the smoke tolerable limit value setting device may set the smoke tolerable limit value such that the detected concentration of oxygen is deemed to be identical with the concentration of oxygen in the air. The EGR valve includes a mechanical working part. The fully closed condition of the mechanical working part can be detected with a higher reliability compared to the detection of the concentration of oxygen. Furthermore, when the EGR valve is fully closed, the intake gas contains no EGR gas, and thus the concentration of oxygen in the intake gas is identical with the concentration of oxygen in the air (the atmosphere). Accordingly, in the case when the fully closed condition of the EGR valve is detected, the smoke tolerable limit value can be set with a high accuracy by setting the concentration of oxygen to be identical with the concentration of oxygen in the air, while eliminating the effect of detection errors (including estimated errors) of the concentration of oxygen.

In the aspect of detecting the concentration of oxygen, the smoke tolerable limit value setting device may determine the smoke tolerable limit value corresponding to a predetermined concentration of oxygen on the basis of the amount of oxygen detected by the oxygen amount detection device, correct the determined smoke tolerable limit value according to the difference between the concentration of oxygen detected by the concentration detection device and the predetermined concentration of oxygen, and set the corrected smoke tolerable limit value to the smoke tolerable limit value in the final form. In this aspect, at least in the region where the correlation between the variation of the concentration of oxygen and the variation of the smoke tolerable limit value is deemed roughly unchanged, the smoke tolerable limit value corresponding to the actual amount of oxygen and concentration of oxygen can be determined with a relatively high reliability as followings: a correspondence relation between the amount of oxygen and the smoke tolerable limit value is obtained in advance with reference to a predetermined concentration of oxygen; and the smoke tolerable limit value is corrected according to the difference between the concentration of oxygen as the reference point and the actual concentration of oxygen. When such a correction is employed, the smoke tolerable limit values need not be obtained in advance for all range of the practically supposed concentration of oxygen in the internal combustion engine, whereby the time and work necessary to determine the smoke tolerable limit value can be reduced.

In the above aspects, the smoke tolerable limit value setting device may determine two smoke tolerable limit values corresponding to the amount of oxygen detected by the oxygen amount detection device using map data describing the relation between the amount of oxygen and the smoke tolerable limit values when the concentration of oxygen is controlled at its maximum or its minimum, interpolate the smoke tolerable limit value corresponding to the concentration of oxygen detected by the concentration detection device between the determined two smoke tolerable limit values, and set the interpolated smoke tolerable limit value to the smoke tolerable limit value in the final form. In this case, once the map data is created by obtaining the correspondence relation between the amount of oxygen and the smoke tolerable limit value in advance with reference to the conditions when the concentration of oxygen is set to its maximum or its minimum, respectively, namely, when the EGR valve is controlled fully closed or fully opened, respectively, the smoke tolerable limit value corresponding to the actual concentration of oxygen can be obtained simply as followings: the smoke tolerable limit values each corresponding to the maximum or the minimum concentration of oxygen is determined from the map data; and between the determined smoke tolerable limit values is employed an interpolation according to the difference between the actual concentration of oxygen and the maximum or minimum concentration of oxygen. When such an interpolation is employed, the size of the map data necessary to determine the smoke tolerable limit value with reference to the concentration of oxygen and the time and work required for creating the map data can be reduced, thereby to improve the efficiency of the bench test.

In an aspect of the present invention, the concentration detection device may detect the concentration of the EGR gas as the concentration of the specific gas; and the smoke tolerable limit value setting device may set the smoke tolerable limit value on the basis of the detected amount of oxygen and concentration of the EGR gas. Since the concentration of the EGR gas (including the case when it is defined as an EGR ratio) correlates strongly with the composition of the intake gas, the present invention can be applied using the detected value of the EGR gas concentration, without directly detecting the concentration of oxygen.

In an aspect of the present invention, the concentration detection device may detect the opening degree of the EGR valve provided to the EGR device for regulating the EGR ratio as the value representing the concentration of the specific gas; and the smoke tolerable limit value setting device may set the smoke tolerable limit value on the basis of the detected amount of oxygen and the detected opening degree of the EGR valve. When the variation of the differential pressure between the upstream and downstream sides of the EGR passage is significantly small, the opening degree of the EGR valve correlates relatively strongly with the concentration of the EGR gas. Accordingly, the present invention can be applied using the detected opening degree of the EGR valve in stead of the concentration of oxygen, even when the concentration of oxygen or the concentration of the EGR gas can not be detected directly.

In an aspect of the present invention, the fuel injection control device may further include a fuel injection amount limiting device which compares a required amount of fuel injection determined on the basis of the operating condition of the internal combustion engine with the smoke tolerable limit value determined by the smoke tolerable limit value setting device, and limits the amount of fuel to be introduced into the cylinder to the smoke tolerable limit value when the required amount of fuel injection is larger than the smoke tolerable limit value setting device. In this aspect, the amount of the fuel exceeding the smoke tolerable limit value is not introduced into the cylinder, whereby the generation of smoke can be suppressed certainly to the tolerance range.

As described above, according to the present invention, the smoke tolerable limit value as the upper limit of the amount of fuel injection is set with reference not only to the amount of oxygen in the intake gas but also to the concentrations of the specific gas components or the values representing their concentrations, such as the concentration of oxygen, the EGR gas concentration, or the opening degree of the EGR valve. Accordingly, the accuracy of the control of combustion speed regarding smoke suppression can be improved by reflecting the effect of the variation of the composition of the intake gas on the generation of smoke in the smoke tolerable limit value.

BRIEF DESCRIPTION OF THE DRAWINGS

FIG. 1 is a view showing a schematic configuration of a diesel engine in which a fuel injection control device according to an embodiment of the present invention is applied to;

BEST MODES FOR CARRYING OUT THE INVENTION

First Embodiment

Figure 1:
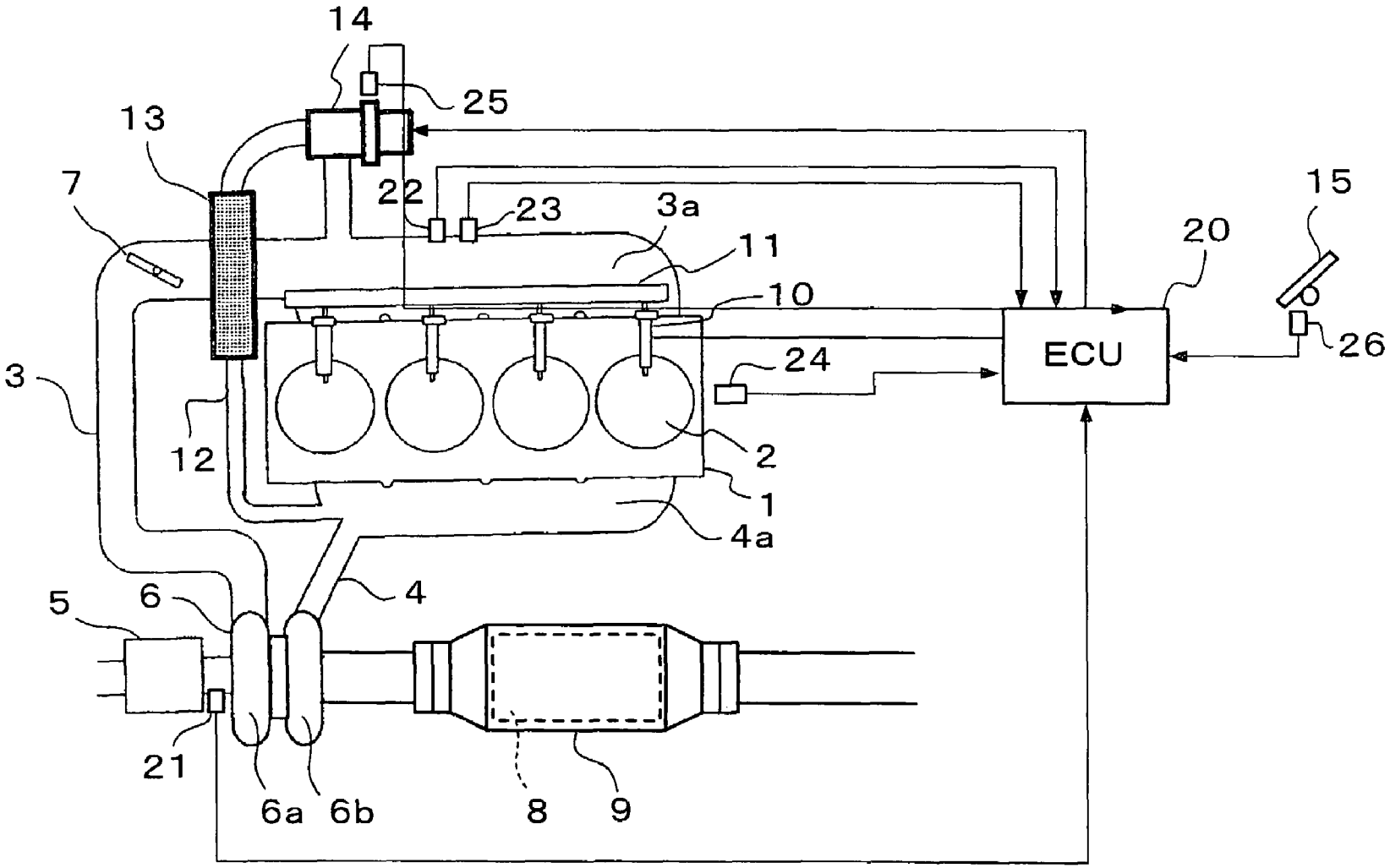

FIG. 1 shows an embodiment of a fuel injection control device according to the present invention that is applied to a diesel engine 1 (referred to as engine, hereinafter) as an internal combustion engine. The engine 1 is installed in the vehicle as a drive power source. The engine 1 includes multiple cylinders 2 (four in the figure), to which an intake passage 3 and an exhaust passage 4 are connected to. The intake passage 3 is provided with an air filter 5 for filtering intake air, a compressor 6*a* of a turbocharger 6, and a throttle valve 7 for regulating an intake gas amount; and the exhaust passage 4 is provided with a turbine 6*b* of the turbocharger 6. An exhaust gas purifying device 9 including an exhaust gas purifying catalyst converter 8 (a NOx storage reduction type exhaust purifying catalyst converter, for example) is provided in the downstream section of the exhaust passage 4 from the turbine 6*b*. The engine 1 is equipped with fuel injection valves 10 for injecting fuel into the cylinders (to inside the cylinders 2) and a common rail 11 for storing high-pressurized fuel which is to be supplied to each fuel injection valve 10. An EGR passage 12 is formed between the exhaust manifold 4*a* of the exhaust passage 4 and the intake manifold 3*a* of the intake passage 3. The EGR passage 12 is provided with an EGR cooler 13 and an EGR valve 14. An EGR device is configured from the EGR passage 12, the EGR cooler 13, and the EGR valve 14.

The operating condition of the engine 1 is controlled by an engine control device (ECU) 20. The ECU 20 is configured as a computer device using a microprocessor, and controls the operating condition of the engine 1 in the predetermined target condition by manipulating various actuators to be controlled, such as the above-mentioned fuel injection valve 10, a pressure regulating valve (not shown) for the common rail 11, and the EGR valve 14. To the ECU 20 are connected an airflow meter 21, an intake pipe pressure sensor 22, an oxygen concentration sensor 23, a crank angle sensor 24, an EGR valve lift sensor 25, and an accelerator opening degree sensor 26 as means for detecting various physical quantities or state quantities to be referred in control of the engine 1. Furthermore, various sensors, such as a water temperature sensor for detecting the temperature of cooling water in the engine 1, an intake gas temperature sensor for detecting the temperature of the intake air, and an A/F sensor for detecting the air fuel ration of the exhaust gas are connected to the engine 1; and these are not shown in the figure.

The airflow meter 21 outputs a signal corresponding to the amount (the mass flow rate in a precise sense) GA of the intake air withdrawn into the intake passage 3. The intake pipe pressure sensor 22 outputs a signal corresponding to the pressure PM of the intake gas at the intake manifold 3*a* in the intake passage 3. The intake gas is an intake air withdrawn from the outside of the engine 1 into the intake passage 3, in other words, a mixed gas of a fresh air and the EGR gas introduced into the intake passage 3 through the EGR passage 12. The oxygen concentration sensor 23 outputs a signal corresponding to the concentration of oxygen OXC in the intake gas at the intake manifold 3*a* in the intake passage 3. The crank angle sensor 24 outputs a pulse train signal of the frequency corresponding to the angular speed of the crank shaft of the engine 1 and outputs a detection signal of the reference position of the crank shaft. The ECU 20 determines the rotational position of the crank shaft and the rotation number (rotational speed) NE of the engine 1 based on the output signal of the crank angle sensor 24. The EGR valve lift sensor 25 detects mechanically the fully closed position of the EGR valve, and outputs a signal corresponding to the lift amount (opening degree) of the EGR valve from the fully closed position of the EGR valve. The accelerator opening degree sensor 26 outputs a signal corresponding to the opening degree of the accelerator pedal 15, namely, the press-down amount of the accelerator pedal 15.

The ECU 20 obtains a base fuel injection amount QBASE of fuel from a predetermined base fuel injection amount map on the basis of the engine rotation number NE determined based on the output of the crank angle sensor 24 and the opening degree of the accelerator pedal (which corresponds to the load of the engine 1) determined based on the output signal of the accelerator opening degree sensor 26. The ECU 20 corrects the obtained base injection amount QBASE according to the signals from the various sensors, determines an instructional injection amount QFIN in the final form, and controls the fuel injection operation of the fuel injection valve 10 such that the determined instructional injection amount QFIN is realized. The ECU 20 also sets a target EGR ratio according to the operating condition of the engine 1 which is determined based on the outputs of various sensors, and controls the opening degree of the EGR valve 14 with reference to the output of the EGR valve lift sensor 25 such that the target EGR ratio is realized. The target EGR ratio is set, for example, such that the amount of generated NOx in the engine 1 is suppressed to a predetermined tolerable limit. The control of the opening degree of the EGR valve 14 may be configured from another view; and the algorithm of controlling the opening degree may be appropriately modified.

Figure 2:
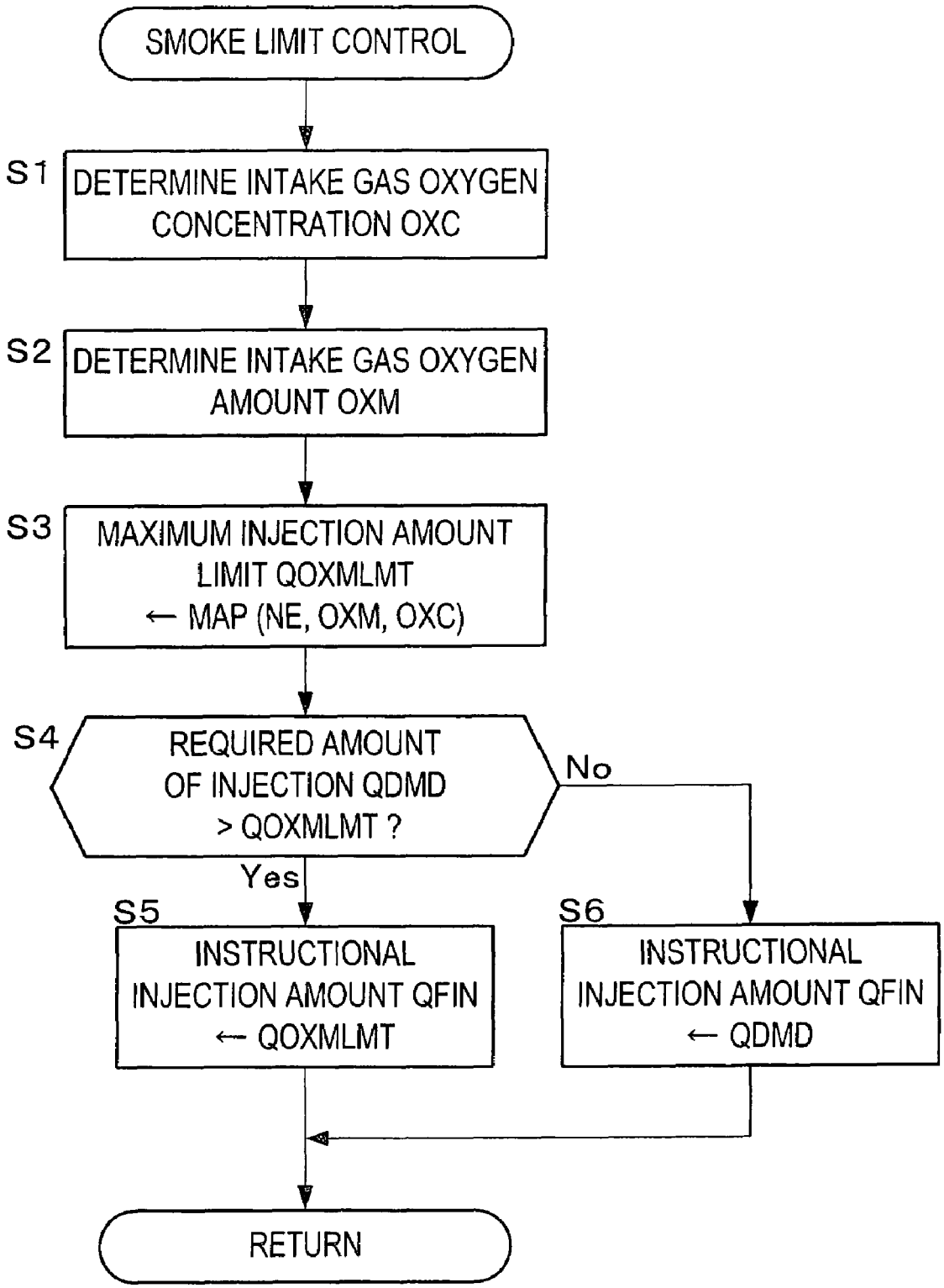
FIG. 2 is a flowchart showing a smoke limit control routine performed by the ECU for the smoke limit control regarding the amount of fuel injection.

Furthermore, the ECU 20 performs a smoke limit control, in which the ECU 20 limits the instructional injection amount QFIN with reference to the amount of oxygen and the concentration of oxygen in the intake gas, in order to suppress the amount of generated smoke in the engine 1 to the predetermined smoke tolerable limit value. FIG. 2 is a flowchart showing the smoke limit control routine which is repeatedly performed for the smoke limit control by the ECU 20 in a predetermined period (which is equal to the period for computing the amount of fuel injection in the regular case). Namely, in the routine, the maximum fuel injection amount limit QOXMLMT regarding the amount of fuel injection is determined with reference to the map of FIG. 3 according to the amount of oxygen OXM in the intake gas, the concentration of oxygen OXC, and the engine rotation number NE; and the instructional injection amount QFIN is limited so as not to exceed the maximum fuel injection amount limit QOXMLMT.

Figure 3:
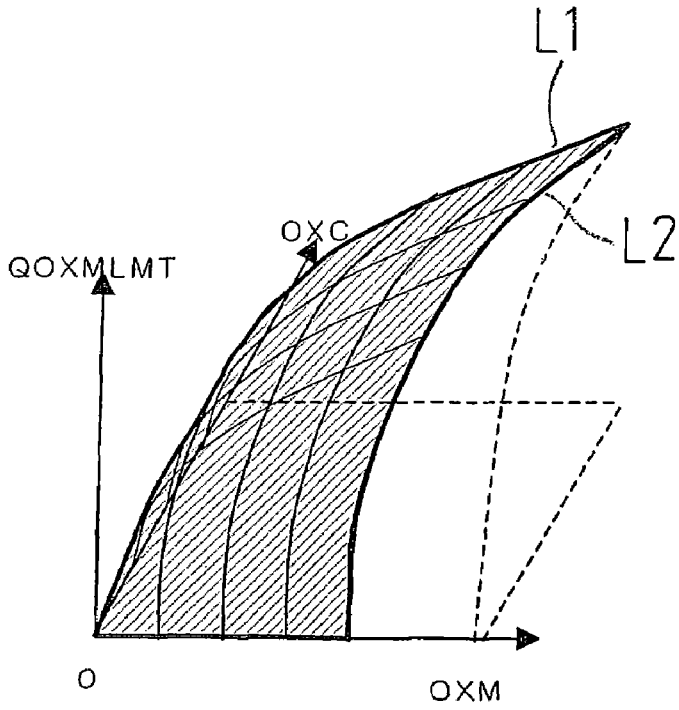
FIG. 3 is a view showing an example of a three-dimensional map illustrating correlations between the amount of oxygen, the concentration of oxygen, and the maximum fuel injection amount limit, which are referred to in the routine of FIG. 2.
Figure 4:
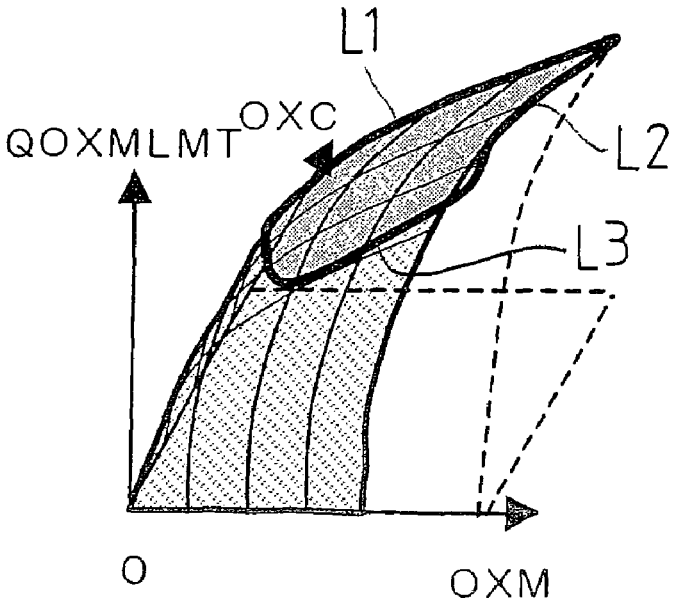
FIG. 4 is a view showing a region practically used in the three-dimensional map of FIG. 3.

The map of FIG. 3 is a three-dimensional map illustrating relations between the amount of oxygen OXM and concentration of oxygen OXC in the intake gas and the maximum fuel injection amount limit QOXMLMT when the engine rotation number NE is fixed to a predetermined value. The maximum fuel injection amount limit QOXMLMT is the maximum amount of fuel injection which can suppress the amount of smoke generated in the engine 1 to a predetermined tolerance range; and corresponds to the smoke tolerable limit value regarding the amount of fuel injection. The generation of smoke correlates with the combustion speed in the cylinder, and the combustion speed is affected by the amount of oxygen OXM in the intake gas. However, in the engine 1 with the EGR device, since the weight ratio of the EGR gas in the intake air varies according to the EGR ratio, the composition of the intake gas varies accordingly, even if the amount of oxygen OXM remains unchanged. The combustion speed of the fuel air mixture in the cylinder is affected by the composition of the intake gas. The larger is the partial pressure of a molecule having large specific heat in the intake gas, the more decreases the combustion speed, thereby to increase the amount of generated smoke. Consequently, in this embodiment, the maximum fuel injection amount limit QOXMLMT is determined based on the amount of oxygen OXM and the concentration of oxygen OXC from the three-dimensional map of FIG. 3 by using the concentration of oxygen in the intake gas as an index for evaluating the effect of the composition of the intake gas on the combustion speed, or as an index for determining the combustion condition which affects the generation of smoke.

The solid line L1 in FIG. 3 is a constant oxygen concentration line showing the relation between the amount of oxygen OXM and the maximum fuel injection amount limit QOXMLMT when the EGR ratio is 0, namely, the EGR valve 14 is controlled in a fully closed condition. The solid line L2 is a constant intake gas amount line showing a relation between the amount of oxygen OXM, the concentration of oxygen OXC, and the maximum fuel injection amount limit QOXMLMT when the EGR ratio is at a maximum, namely, the opening degree of the EGR valve 14 is controlled in the maximum condition. Along the constant oxygen concentration line, the concentration of oxygen is about 21% of the concentration of oxygen in the air, it is assumed 21%, hereinafter. Multiple representative points are set for the amount of oxygen OXM and the concentration of oxygen OXC, respectively, in the hatched region surrounded by both lines L1 and L2. The maximum fuel injection amount limit QOXMLMT is obtained in advance in a bench test for each of the combinations of their representative points, thereby to obtain the map of FIG. 3. Such a map is created for each of multiple representative rotation numbers NE and stored in the ROM of the ECU 20 in advance, whereby the maximum fuel injection amount limit QOXMLMT corresponding to the engine rotation number NE, the amount of oxygen OXM, and the concentration of oxygen OXC can be determined.

Returning to FIG. 2, in the smoke limit control routine of FIG. 2, the ECU 20 at first determines in step S1 the concentration of oxygen OXC in the intake gas based on the output of the oxygen concentration sensor 23. By performing the process, the ECU 20 acts as the concentration detection device. Preferably, in determining the concentration of oxygen OXC, it is corrected with taking account of the response delay of the oxygen concentration sensor 23. In the next step S2, the ECU 20 determines the amount of oxygen in the intake gas OXM. The amount of oxygen OXM can be obtained, for example, using the following procedure. The intake pipe pressure PM is determined based on the output of the intake pipe pressure sensor 22. The intake gas amount GASIN is obtained based on the intake pipe pressure PM and the engine rotation number NE from the predetermined intake gas amount map. The amount of oxygen OXM contained in the intake gas can be obtained by multiplying the intake gas amount GASIN by the concentration of oxygen OXC and the oxygen density. By performing the process, the ECU 20 acts as the oxygen amount detection device.

In the next step S3, the ECU 20 selects the map of the maximum fuel injection amount limit QOXMLMT corresponding to the current engine rotation number NE, and determines from the map the maximum fuel injection amount limit QOXMLMT corresponding to the concentration of oxygen OXC and the amount of oxygen OXM. By performing the process, the ECU 20 acts as the smoke tolerable limit value setting device. Next, the ECU 20 advances to step S4, and determines whether or not the required amount of injection QDMD is larger than the maximum fuel injection amount limit QOXMLMT. The required amount of injection QDMD is a value obtained by correcting the base amount of fuel injection QBASE, which is obtained from the engine rotation number and the opening degree of the accelerator pedal, in accordance with the temperature of the intake gas, the temperature of the cooling water, or the like. The required amount of injection QDMD is also the amount of fuel injection which is determined in accordance with the current operating condition of the engine 1 for realizing the operation condition requested to the engine 1.

In the case when the required amount of injection QDMD is larger than the maximum fuel injection amount limit QOXMLMT in step S4, the ECU 20 advances to step S5, and determines the maximum fuel injection amount limit QOXMLMT as the instructional injection amount QFIN. On the other hand, when the required amount of injection QDMD is equal to or less than the maximum fuel injection amount limit QOXMLMT in step 4, the ECU 20 advances to step S6, and determines the required amount of injection QDMD as the instructional injection amount QFIN. By processing the step S5, the ECU 20 acts as the fuel injection amount limiting device. After determining the instructional injection amount QFIN, the ECU 20 ends the routine of FIG. 2, and controls the operation of the fuel injection valve 10 such that the determined instructional injection amount QFIN is realized.

In the above embodiment, the maximum fuel injection amount limit QOXMLMT for suppressing the amount of generated smoke is determined with reference to both the amount of oxygen OXM and the concentration of oxygen OXC in the intake gas. The instructional injection amount QFIN is limited to the maximum fuel injection amount limit QOXMLMT when the required amount of injection QDMD exceeds the maximum fuel injection amount limit QOXMLMT. Accordingly, the generation of smoke can be suppressed more accurately compared to the case when the amount of fuel injection is limited based only on the amount of oxygen OXM.

Second Embodiment

Next, the second embodiment of the present invention will be described with reference to FIGS. 4 to 7. In these figures the same reference number is used for the component in common with the first embodiment, and the description thereof will be omitted. In the above-mentioned first embodiment, the maps are prepared for the whole hatched region shown in FIG. 3 surrounded by the constant oxygen concentration line L1 and the constant intake gas amount line L2. However, it is highly likely that the practical maximum fuel injection amount QOXMLMT is limited to the narrow region in FIG. 4 delimited by the solid line L3. In such a narrow region, the maximum fuel injection amount limit QOXMLMT varies while keeping a nearly constant relation with each of the amount of oxygen OXM and the concentration of oxygen OXC. Accordingly, the maximum fuel injection amount limits QOXMLMT along the constant oxygen concentration line L1 and along the constant intake gas amount line L2 are obtained in advance, whereby the maximum fuel injection amount limit QOXMLMT at a middle point, namely, at the point which is apart from the constant oxygen concentration line L1 and the constant intake gas amount line L2 can be interpolated based on these maximum fuel injection amount limits QOXMLMT. Further, by limiting the amount of fuel injection using the interpolated maximum fuel injection amount limit QOXMLMT, the generation of smoke and the variation of the torque characteristics can be suppressed to a practically tolerance range.

Figure 5A:
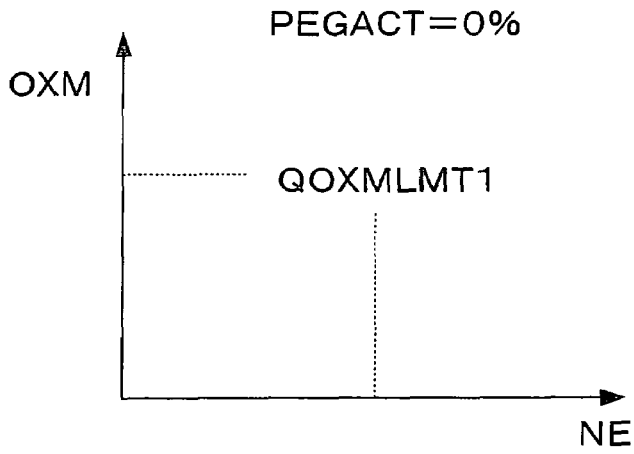
FIG. 5A is a view showing a map illustrating the maximum fuel injection amount limit in a correlated manner with the engine rotation number and the amount of oxygen when the concentration of oxygen is at a maximum.
Figure 5B:
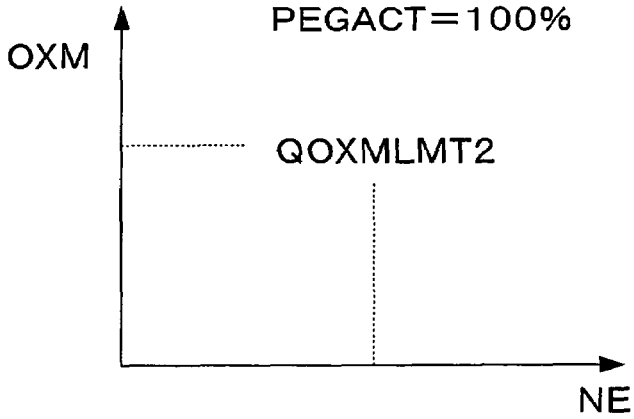
FIG. 5B is a view showing a map illustrating the maximum fuel injection amount limit in a correlated manner with the engine rotation number and the amount of oxygen when the concentration of oxygen is at a minimum.
Figure 5C:
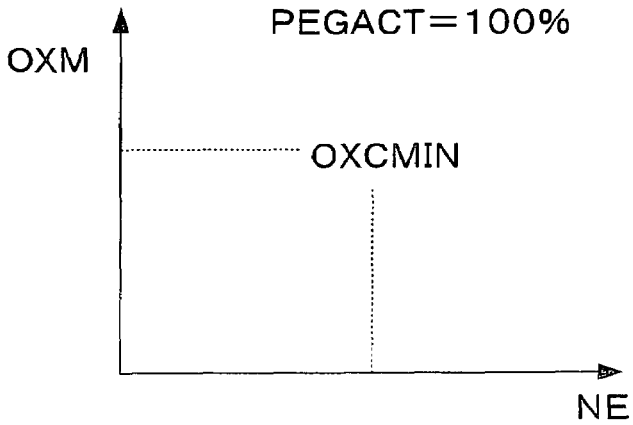
FIG. 5C is a view showing a map illustrating the minimum concentration of oxygen in a correlated manner with the engine rotation number and the amount of oxygen.

Based on the above presumptions, in the second embodiment, three kinds of maps shown in FIGS. 5A to 5C are created in advance and burned in the ROM of the ECU 20 so as to interpolate the maximum fuel injection amount limit QOXMLMT. The map of FIG. 5A is a map in which the maximum fuel injection amount limit QOXMLMT when the opening degree of EGR valve 14 PEGACT is 0%, namely, when the EGR valve 14 is fully closed is correlated with the engine rotation number NE and the amount of oxygen in the intake gas OXM. The map of FIG. 5B is a map in which the maximum fuel injection amount limit QOXMLMT when the opening degree of the EGR valve 14 PEGACT is 100%, namely when the EGR valve 14 is fully opened is correlated with the engine rotation number NE and the amount of oxygen in the intake gas OXM. The map of FIG. 5C is a map in which the concentration of oxygen OXC when the opening degree of the EGR valve 14 PEGACT is 100% is correlated with the engine rotation number NE and the amount of oxygen in the intake gas OXM. Furthermore, the ECU 20 performs the smoke limit control routine of FIG. 6 while using the above maps instead of performing the routine of FIG. 2 in the first embodiment, thereby to control the amount of fuel injection such that the amount of generated smoke does not exceed the tolerable limit.

Figure 6:
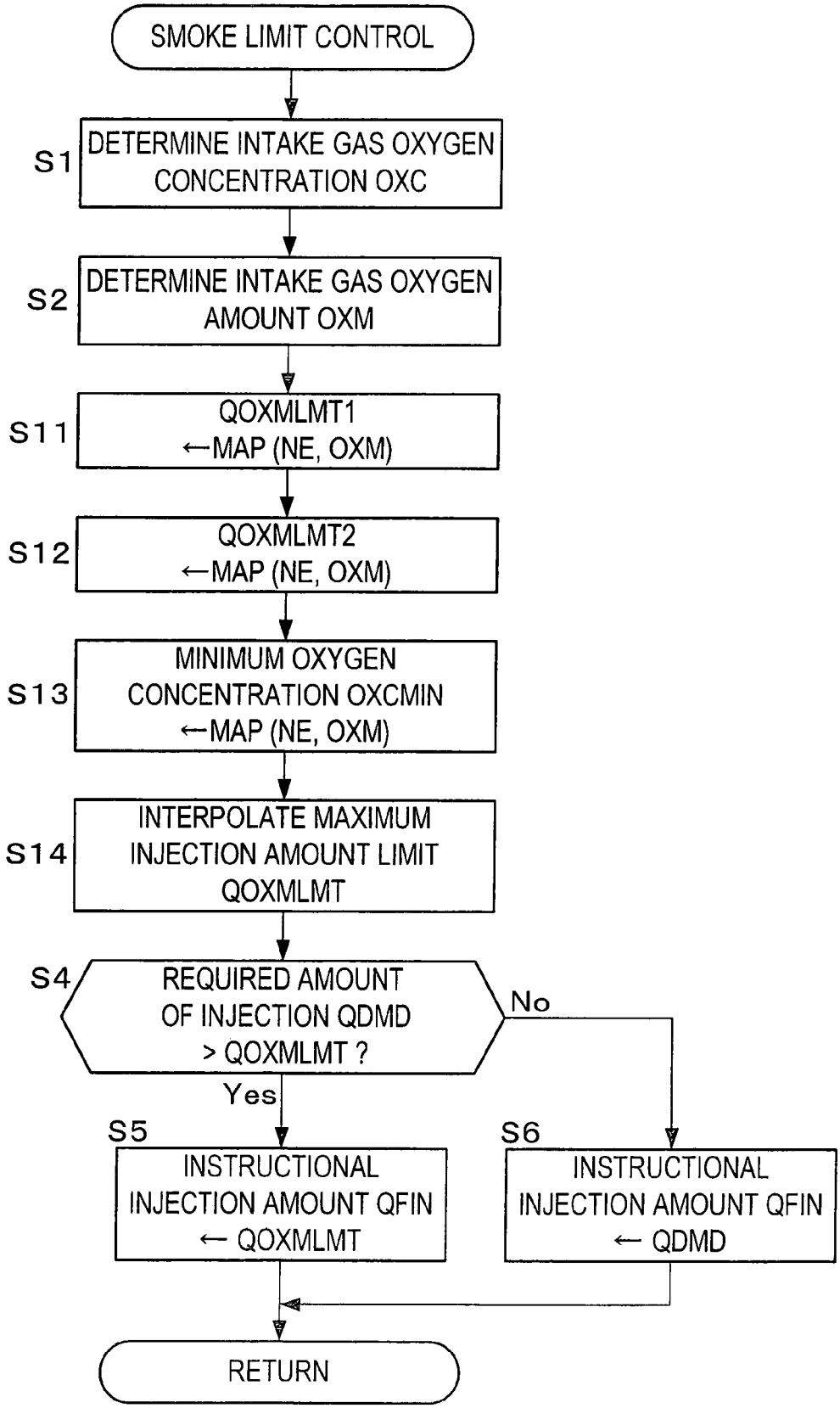
FIG. 6 is a flowchart showing a smoke limit control routine in the second embodiment.

In the smoke limit control routine of FIG. 6, the ECU 20 determines the concentration of oxygen OXC and the amount of oxygen OXM in the intake gas, respectively, in steps S1 and S2, in a similar manner to in the routine of FIG. 2. In the next step S11, the ECU 20 determines the maximum fuel injection amount limit QOXMLMT1 corresponding to the current engine rotation number NE and the amount of oxygen OXM using the map of FIG. 5A. In the next step S12, the ECU 20 determines the maximum fuel injection amount limit QOXMLMT2 corresponding to the current engine rotation number NE and the amount of oxygen OXM using the map of FIG. 5B. Furthermore, in step S13, the ECU 20 determines the minimum concentration of oxygen OXCMIN corresponding to the current engine rotation number NE and the amount of oxygen OXM using the map of FIG. 5C.

Figure 7:
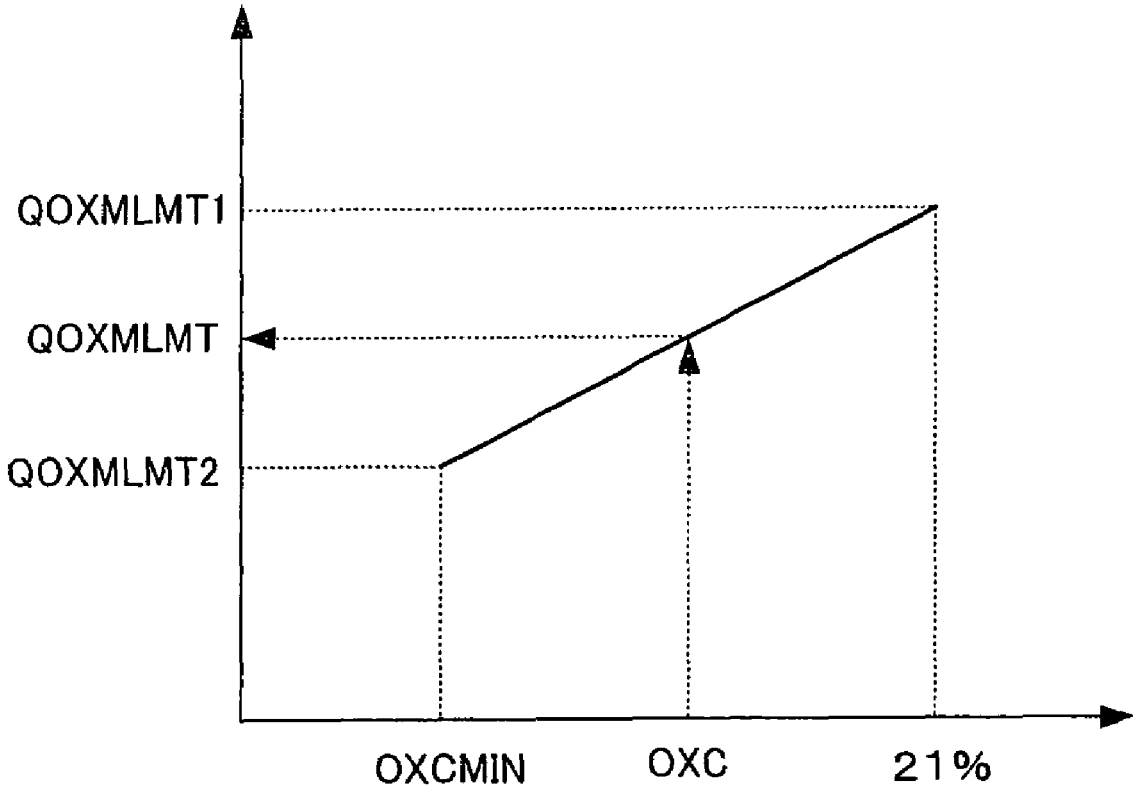
FIG. 7 is a view illustrating an example of interpolation in the routine of FIG. 6.

In the next step S14, the ECU 20 interpolates the maximum fuel injection amount limit QOXMLMT corresponding to the current engine rotation number NE, the amount of oxygen OXM, and the concentration of oxygen OXC on the basis of the maximum fuel injection amount limits QOXMLMT1 and QOXMLMT2, and the minimum concentration of oxygen OXCMIN, which are determined in the steps S11-13. For example, if it is assumed that the maximum fuel injection amount limit QOXMLMT varies in proportion to the concentration of oxygen OXC as shown in FIG. 7 between the maximum fuel injection amount limits QOXMLMT1 and QOXMLMT2, the relation (proportional coefficient) between the variation of the concentration of oxygen and the variation of the maximum fuel injection amount limit QOXMLMT is obtained using the difference between the maximum fuel injection amount limits QOXMLMT1 and QOXMLMT2 and the difference between the maximum concentration of oxygen 21% (that is, the concentration of oxygen when the opening degree of the EGR valve PEGACT=0%) and the minimum concentration of oxygen OXCMIN. The variation of the maximum fuel injection amount limit QOXMLMT corresponding to the shift amount between the current concentration of oxygen OXC and the maximum concentration of oxygen 21% or the minimum concentration of oxygen OXCMIN is obtained using the relation, thereby to interpolate the maximum fuel injection amount limit QOXMLMT corresponding to the current concentration of oxygen OXC. In FIG. 7, it is assumed that the concentration of oxygen and the maximum fuel injection amount limit are in a proportional relation. However, the interpolation of the maximum fuel injection amount QOXMLMT is not limited to a linear interpolation, various interpolating methods may be used. By performing the processes in steps S11-S14, the ECU 20 acts as the smoke tolerable limit value setting device.

Return to FIG. 6, after obtaining the maximum fuel injection amount limit QOXMLMT in step S14, the ECU 20 advances to step S4, and determines whether or not the required amount of injection QDMD is larger than the maximum fuel injection amount limit QOXMLMT. When the required amount of injection QDMD is larger than the maximum fuel injection amount limit QOXMLMT, the ECU 20 determines the maximum fuel injection amount limit QOXMLMT as the instructional injection amount QFIN in step S5. On the other hand, when the required amount of injection QDMD is equal to or less than the maximum fuel injection amount limit QOXMLMT, the ECU 20 determines the required amount of injection QDMD as the instructional injection amount QFIN in step S6. After determining the instructional injection amount QFIN, the ECU 20 ends the routine of FIG. 6, and controls the operation of the fuel injection valve 10 such that the determined instructional injection amount QFIN is realized.

In the second embodiment, since simply preparing the three kinds of maps shown in FIGS. 5A to 5C is enough to determine the maximum fuel injection amount limit QOXMLMT, the capacity of the maps can be reduced compared to in the case when three-dimensional maps of FIG. 3 are prepared for each engine rotation number. Furthermore, the time and work required for a bench test can be reduced by reducing the number of constants to be varied in creating each of the maps, thereby to improve the efficiency of creating the maps.

Third Embodiment

Figure 8:
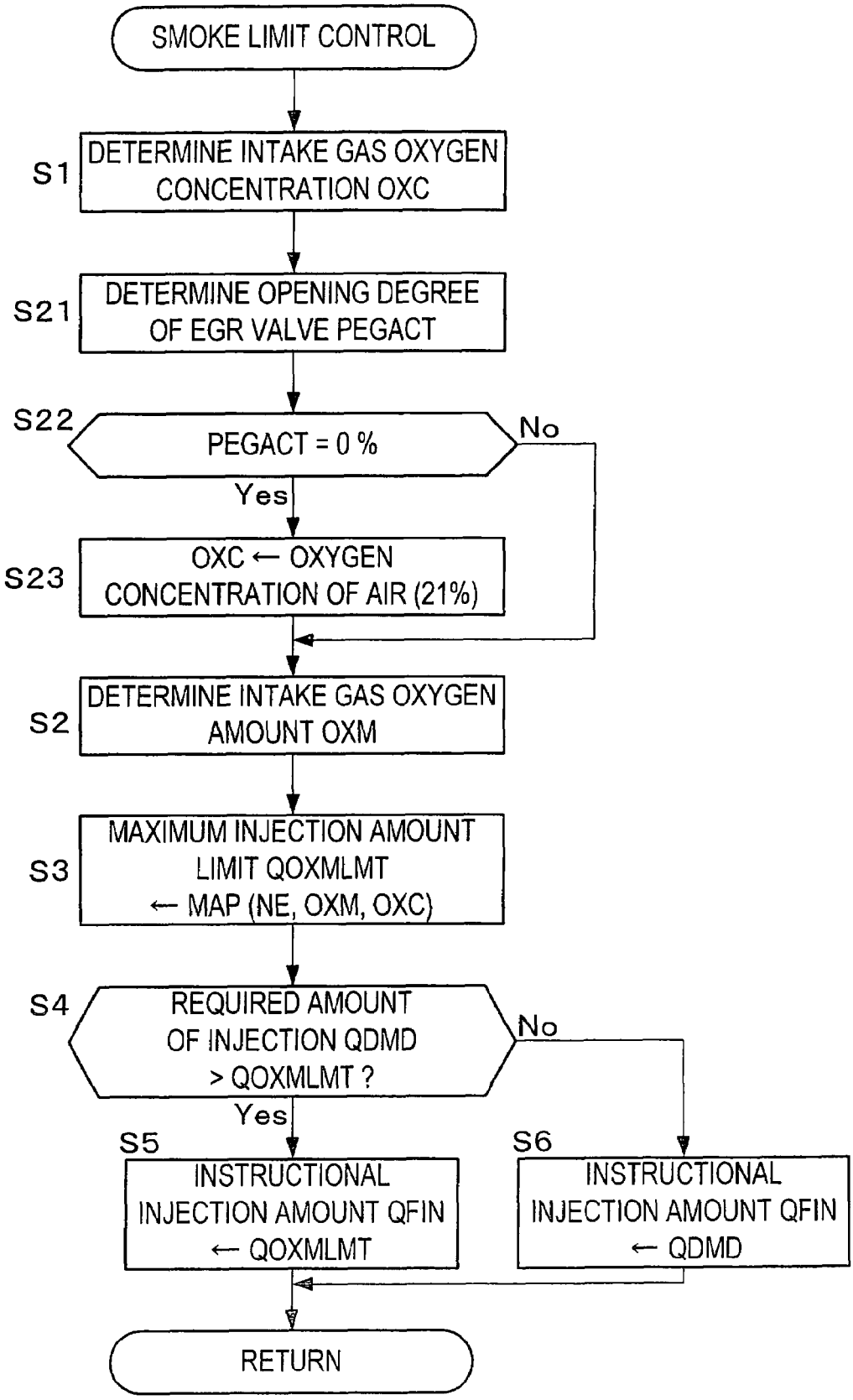
FIG. 8 is a flowchart showing a smoke limit control routine in the third embodiment.

FIG. 8 is a flowchart showing a smoke limit control routine according to the third embodiment of the present invention. The ECU 20 performs the routine of FIG. 8 in stead of the smoke limit control routine of the first embodiment shown in FIG. 2. In the routine, the concentration of oxygen is corrected with reference to the opening degree of the EGR valve PEGACT which is determined based on the output of the EGR valve lift sensor 25. In FIG. 8, the same reference number is used for the component in common with the second embodiment, and the description thereof will be omitted.

In the smoke limit control routine of FIG. 8, the ECU 20 determines the concentration of oxygen OXC in step S1 based on the output of the oxygen concentration sensor 23, then advances to step S21, and determines the opening degree of the EGR valve 14 PEGACT based on the output of the EGR valve lift sensor 25. In the next step S22, the ECU 20 determines whether or not the opening degree of the EGR valve PEGACT is 0%. When PEGACT is 0%, the ECU 20 sets the concentration of oxygen OXC to the concentration of oxygen 21% in the air. On the other hand, when it is determined that the opening degree of the EGR valve PEGACT is not 0%, the ECU 20 skips step S23, and keeps the concentration of oxygen OXC determined in step S1 unchanged for the later processes. Later on, the ECU 20 performs in steps S2-S6 the processes similar to in FIG. 2, thereby to determine the instructional injection amount QFIN.

The reason why the concentration of oxygen is forcedly set to 21% when the opening degree of the EGR valve PEGACT=0%, as described above, is as followings. The detection of the concentration of oxygen using the oxygen concentration sensor 23 may include the response delay or the detection error of the oxygen concentration sensor 23, the estimation error of the concentration of oxygen derived from the output of the sensor, or the like. On the other hand, when the EGR valve 14 is fully closed, the EGR is not performed; and the intake gas is composed of only the air taken from the outside into the intake passage 3. The concentration of oxygen of the intake air is identical with the concentration of oxygen in the air (atmosphere). Since the EGR valve lift sensor 25 detects mechanically the fully closed position of the EGR valve, the reliability of the detection of the fully closed condition is higher than the reliability of the detected value of the concentration of oxygen OXC. Consequently, when the opening degree of the EGR valve is 0%, the concentration of oxygen is determined with a high reliability if the concentration of oxygen OXC is forcedly set to the concentration of oxygen in the air. Furthermore, if the concentration of oxygen is set in this manner, the concentration of oxygen can be determined accurately and the amount of fuel injection can be limited with a high accuracy according to the concentration of oxygen in the high load range at which the EGR is stopped due to the emphasis on the power performance, whereby the generation of smoke can be suppressed more accurately while suppressing the degradation of the power performance.

In the third embodiment, the EGR valve lift sensor 25 corresponds to the fully closed condition detection device. In the process in step S23 of FIG. 8, the timing at which the concentration of oxygen OXC is set to 21% may be determined with reference to the substitution delay of the intake gas. That is, with reference to the delay time in which the whole amount of the intake gas is substituted with the air after the EGR valve 14 is manipulated to the fully closed position, the timing of processing the step S23 may be delayed after the condition is established in step S22. For example, after the condition is established in step S22, the step S23 may be processed after several times of explosions, or after the predetermined delay time elapses. In this case, the number of explosions or the delay time in this case can be set based on the intake air flow rate and the rotation number of the engine 1, or the volumetric charging efficiency of each of the cylinder 2.

Fourth Embodiment

Figure 9:
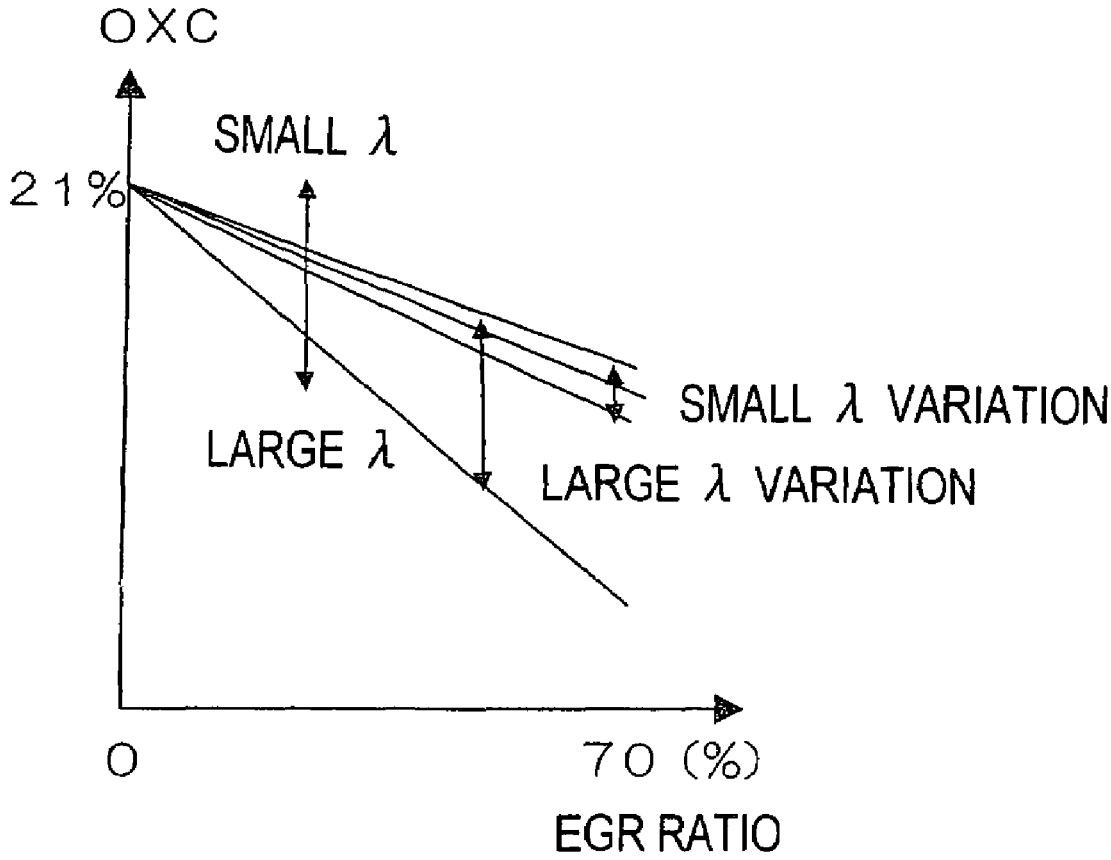
FIG. 9 is a view showing correlations between the EGR ratio and the concentration of oxygen in accordance with the excess air ratios.

Next, the fourth embodiment will be described. The embodiment is intended for the engine 1 having no oxygen concentration sensor 23 and unable to directly detect the concentration of oxygen in the intake gas. A smoke limit control is performed using the EGR ratio (concentration of the EGR gas) in stead of the concentration of oxygen OXC. The next relation is established between the concentration of oxygen OXC and the EGR ratio: OXC≈21% (the concentration of oxygen in the air)×(1−EGR ratio/the excess air ratio λ). Accordingly, in a state when the variation of the excess air ratio λ is small as shown in FIG. 9, the concentration of oxygen OXC can be considered in proportion to the EGR ratio, whereby the smoke limit control can be performed using the EGR ratio in stead of the concentration of oxygen OXC. Furthermore, the EGR ratio is corrected with the excess air ratio λ, so that the concentration of oxygen OXC and the EGR ratio can be treated equivalently.

Figure 10:
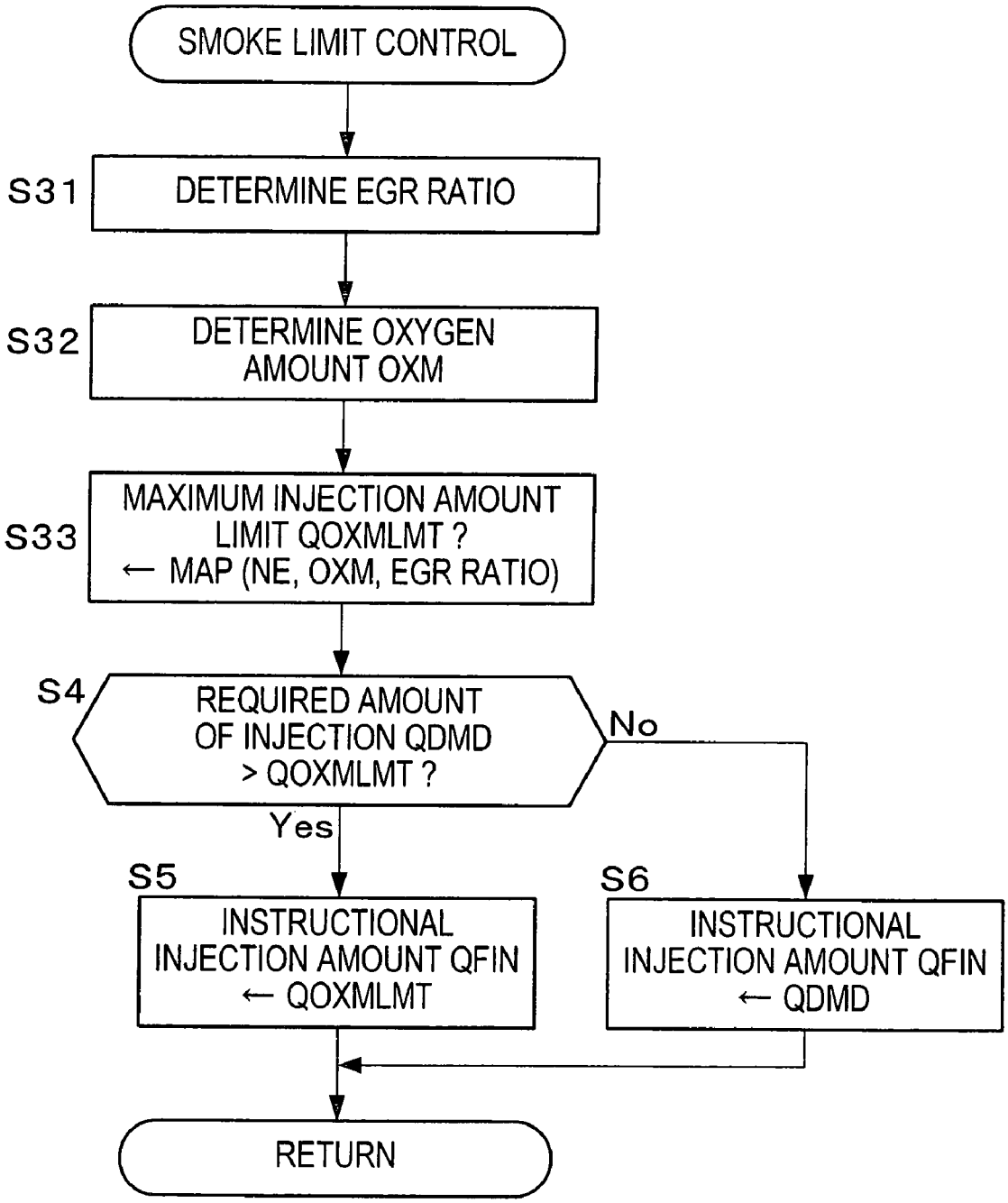
FIG. 10 is a flowchart showing a smoke limit control routine in the fourth embodiment.

FIG. 10 shows the smoke limit control routine in the case when the EGR ratio is used in stead of the concentration of oxygen OXC. In the routine of FIG. 10, the ECU 20 at first determines the EGR ratio in step S31. The EGR ratio can be determined using various known methods. For example, the intake pipe pressure PM is determined based on the output of the intake pipe pressure sensor 22; and the intake gas amount GASIN is obtained from the predetermined intake gas amount map on the basis of the intake pipe pressure PM and the engine rotation number NE. The intake air amount GA is obtained based on the output of the airflow meter 21. The EGR gas amount can be obtained by getting the difference between the intake gas amount GASIN and the intake air amount GA. Then, the EGR ratio can be determined from these values.

In the next step S32, the ECU 20 determines the amount of oxygen OXM in the intake gas. Since the concentration of oxygen OXC is undetermined in this embodiment, the amount of oxygen OXM needs to be determined with a method different from that of the first embodiment. For example, in the case when the air fuel ratio upstream of the exhaust gas purifying catalyst converter 8 can be determined with the A/F sensor or the like, the amount of oxygen OXM can be obtained using the air fuel ratio and the EGR gas amount. That is, as long as the air fuel ration in the exhaust gas is determined, the concentration of oxygen in the exhaust gas can be determined; and the concentration of oxygen in the EGR gas is identical with that in the exhaust gas at the time when the air fuel ratio is detected. On the other hand, the EGR gas amount can be obtained using the procedure described in the determination of the above-mentioned EGR ratio. Then, the amount of oxygen contained in the EGR gas can be obtained from the EGR gas amount and the concentration of oxygen of the EGR gas. The EGR gas and the fresh air are introduced into the intake manifold 3*a* as the intake gas; and the amount of oxygen in the fresh air can be obtained by multiplying the intake air amount GA detected by the airflow meter 21 with the concentration of oxygen (21%) in the atmosphere. Accordingly, the amount of oxygen OXM in the intake gas can be obtained by summing up the amount of oxygen obtained from the intake air amount GA and the amount of oxygen in the EGR gas. Alternatively, since the EGR ratio is determined in this embodiment, the concentration of oxygen OXC is obtained from the above relation expression between the EGR ratio and the concentration of oxygen OXC; and the amount of oxygen OXM can be obtained based on the concentration of oxygen OXC. In this case, the excess air ratio λ needs to be obtained, which can be detected by the A/F sensor in the exhaust gas.

In the next step S33, the ECU 20 determines the maximum fuel injection amount limit QOXMLMT corresponding to the engine rotation number NE, the amount of oxygen OXM, and the EGR ratio on the basis of the map. The map is a map in which the EGR ratio is used as a constant in the map shown in FIG. 3 in stead of the concentration of oxygen OXC. After the maximum fuel injection amount limit QOXMLMT is determined, the ECU 20 performs the processes of the steps S4-S6 in a similar manner to in FIG. 2, thereby to determine the instructional injection amount QFIN. In this embodiment, the ECU 20 acts as the concentration detection device in step S31, acts as the oxygen amount detection device in step S32, and acts as the smoke tolerable limit value setting device in step S33.

Fifth Embodiment

Figure 11:
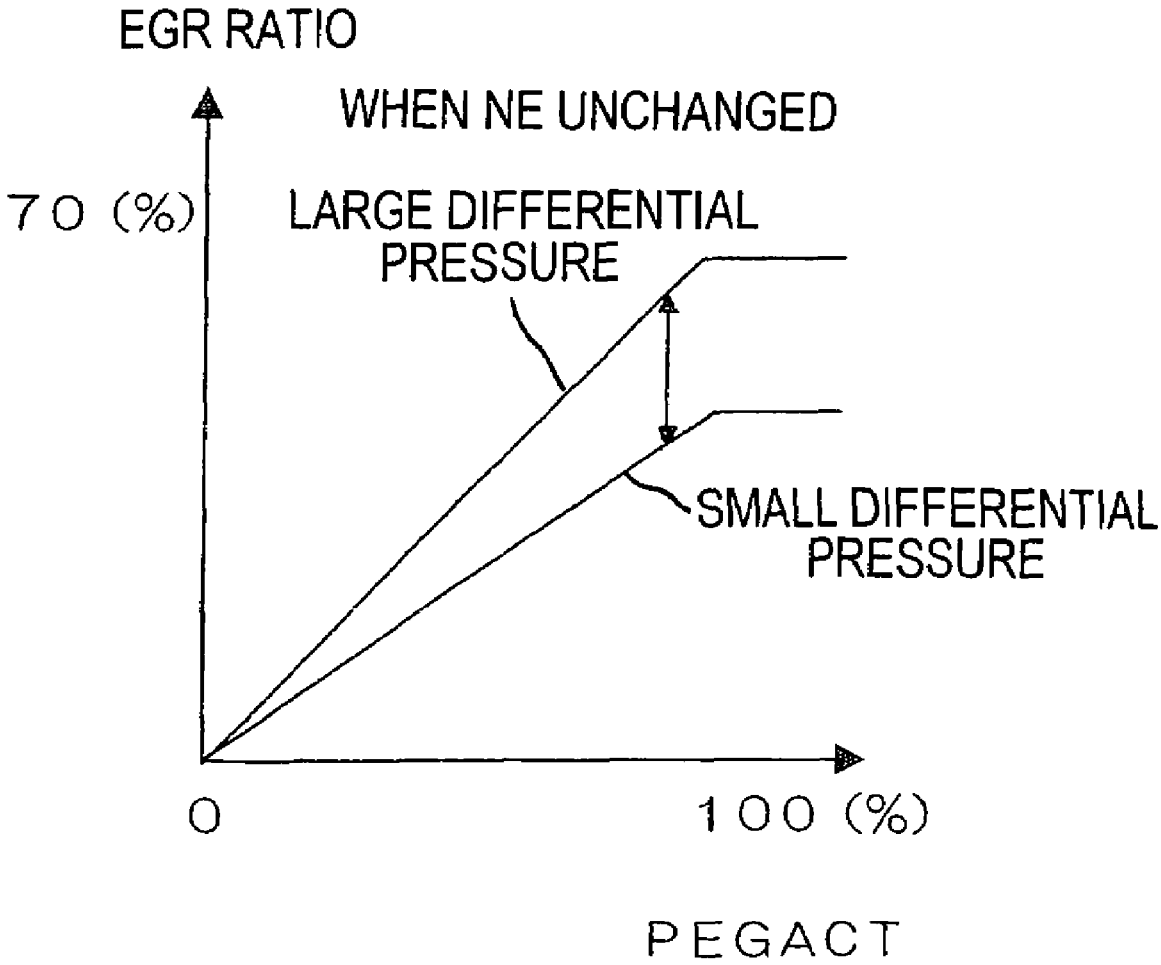
FIG. 11 is a view showing correlations between the opening degree of the EGR valve and the EGR ratio in accordance with the differential pressures between the upstream and downstream sides of the EGR passage.

Next, the fifth embodiment will be described. The embodiment is intended for the engine 1 unable to detect the concentration of oxygen with the oxygen concentration sensor 23 and unable to detect the EGR ratio. A smoke limit control is performed using the opening degree of the EGR valve PEGACT instead of the concentration of oxygen OXC and the EGR ratio. As shown in FIG. 11, correlations exist between the opening degree of the EGR valve PEGACT and the EGR ratio, the relations vary in accordance with the differential pressure between the pressures at the inlet and outlet of the EGR passage 12, namely between the intake pipe pressure and the exhaust pipe pressure. However, if the variation of the differential pressure is to a considerably small range, the EGR ratio and the opening degree of the EGR valve PEGACT can be considered equivalent, whereby the smoke limit control can be performed by substituting the concentration of oxygen OXC with the opening degree of the EGR valve PEGACT. Furthermore, by using the opening degree of the EGR valve PEGACT corrected with the intake pipe pressure and the exhaust pipe pressure, the corrected value can be treated equivalently with the concentration of oxygen OXC or the EGR ratio.

Figure 12:
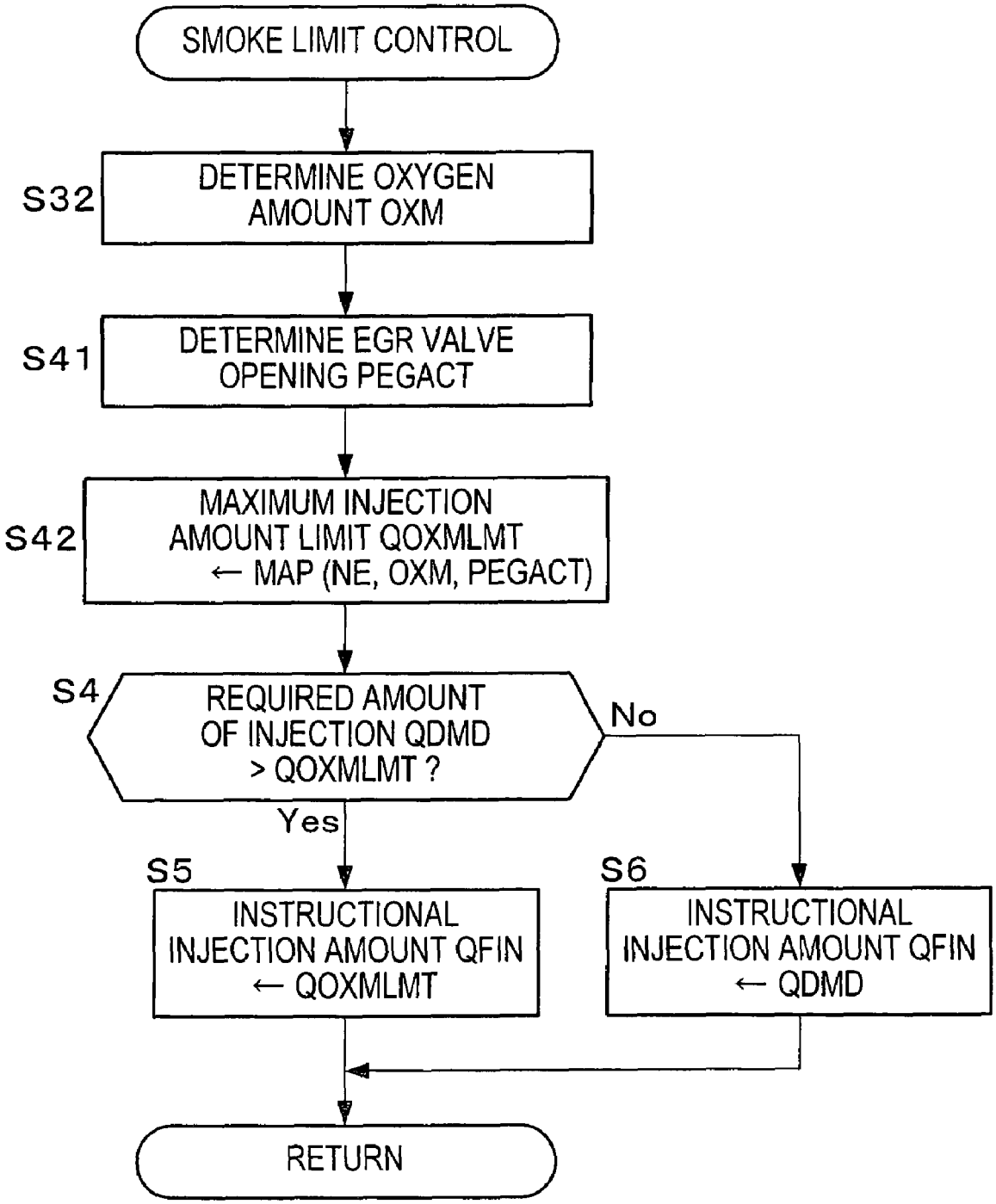
FIG. 12 is a flowchart showing a smoke limit control routine in the fifth embodiment.

FIG. 12 shows the smoke limit control routine when the opening degree of the EGR valve PEGACT is used in stead of the concentration of oxygen OXC. In the routine of FIG. 12, the ECU 20 at first determines the amount of oxygen OXM in step S2. In this case, to the determination method of the amount of oxygen OXM can be applied the method for determining the amount of oxygen OXM using the air fuel ratio and the EGR gas amount can be applied, for example, as described in step S32 of FIG. 10. In the next step S41, the ECU 20 determines the opening degree of the EGR valve PEGACT based on the output of the EGR valve lift sensor 25. Then, in step S42, the ECU 20 determines the maximum fuel injection amount limit QOXMLMT corresponding to the engine rotation number NE, the amount of oxygen OXM, and the opening degree of the EGR valve PEGACT on the basis of the map. The map is a map in which the opening degree of the EGR valve PEGACT is used as a constant in the map shown in FIG. 3 in stead of the concentration of oxygen OXC. After the maximum fuel injection amount limit QOXMLMT is determined, the ECU 20 performs the processes of the steps S4-S6 in a similar manner to in FIG. 2, thereby to determine the instructional injection amount QFIN. In this embodiment, the ECU 20 acts as the oxygen amount detection device in step S32, acts as the concentration detection device in step S41, and acts as smoke tolerable limit value setting device in step S42.

The present invention is not limited to the above embodiments, and may be embodied in various modes. For example, the detection of the concentration of oxygen and the amount of oxygen are not limited to the methods in the above embodiments; and various methods can be used therefor. In the above embodiments, the concentration of oxygen or the concentration of the EGR gas is detected as the concentration of the specific gas contained in the intake gas. However, the concentration of other gas such as CO2 or H2O is determined, then, the smoke tolerable limit value regarding the amount of fuel injection (the maximum fuel injection amount limit) may be determined based on the results of the detection. The method for detecting the amount of oxygen includes not only direct methods in which the amount is directly detected using a sensor for outputting a signal corresponding to the amount of oxygen or the like, but also indirect methods of indirectly detecting the amount of oxygen in which the physical quantities or state quantities correlated with the amount of oxygen is detected and then the amount of oxygen is computed or estimated from the result of the detection. The method for detecting the concentration of the specific gas, such as oxygen, or the EGR gas, includes direct methods in which the concentration is directly detected using a sensor for outputting a signal corresponding to the concentration or the like, but also indirect methods for indirectly detecting the concentration of the specific gas in which the physical quantities or state quantities correlated with the concentration is detected and then the concentration is computed or estimated from the result of the detection. The present invention is not limited to a diesel engine, and can be also applied to a spark ignition internal combustion engine using gasoline as fuel. For example, the present invention can be used effectively for suppressing the smoke in the stratified charge combustion in a cylinder injection internal combustion engine in which fuel is directly injected into the cylinder.

The invention claimed is:

1. A fuel injection control device applied to an internal combustion engine having an EGR device for returning, as a part of an intake gas flown into the cylinder, an EGR gas, withdrawn from an exhaust passage, to an intake passage, comprising:

an oxygen amount detection device for detecting the amount of oxygen contained in the intake gas;

a concentration detection device for detecting the concentration of a specific gas contained in the intake gas or a value representing the concentration; and a smoke tolerable limit value setting device for setting the smoke tolerable limit value as the upper limit of an amount of fuel injection, which can suppress an amount of smoke generated in the engine to a predetermined tolerance range, based on the results detected by the oxygen amount detection device and the concentration detection device, wherein the concentration detection device detects the concentration of oxygen as the concentration of the specific gas, and the smoke tolerable limit value setting device sets the smoke tolerable limit value on the basis of the detected amount of oxygen and concentration of oxygen, and wherein the smoke tolerable limit value setting device determines the smoke tolerable limit value corresponding to a predetermined concentration of oxygen on the basis of the amount of oxygen detected by the oxygen amount detection device, corrects the determined smoke tolerable limit value according to the difference between the concentration of oxygen detected by the concentration detection device and the predetermined concentration of oxygen, and sets the corrected smoke tolerable limit value to the smoke tolerable limit value in the final form.

2. The fuel injection control device according to claim 1, wherein the smoke tolerable limit value setting device determines two smoke tolerable limit values corresponding to the amount of oxygen detected by the oxygen amount detection device using map data describing the relation between the amount of oxygen and the smoke tolerable limit values when the concentration of oxygen is controlled at its maximum or its minimum, interpolates the smoke tolerable limit value corresponding to the concentration of oxygen detected by the concentration detection device between the determined two smoke tolerable limit values, and sets the interpolated smoke tolerable limit value to the smoke tolerable limit value in the final form.

3. A fuel injection control device applied to an internal combustion engine having an EGR device for returning, as a part of an intake gas flown into the cylinder, an EGR gas, withdrawn from an exhaust passage, to an intake passage, comprising:

an oxygen amount detection device for detecting the amount of oxygen contained in the intake gas;

a concentration detection device for detecting the concentration of a specific gas contained in the intake gas or a value representing the concentration;

a smoke tolerable limit value setting device for setting the smoke tolerable limit value as the upper limit of an amount of fuel injection, which can suppress an amount of smoke generated in the engine to a predetermined tolerance range, based on the results detected by the oxygen amount detection device and the concentration detection device; and a fuel injection amount limiting device which compares a required amount of fuel injection determined on the basis of the operating condition of the internal combustion engine with the smoke tolerable limit value determined by the smoke tolerable limit value setting device, and limits the amount of fuel to be introduced into the cylinder to the smoke tolerable limit value when the required amount of fuel injection is larger than the smoke tolerable limit value setting device.

* * * * *